United States Patent [19]

Hershcovitch et al.

[11] 4,377,773

[45] Mar. 22, 1983

[54] NEGATIVE ION SOURCE WITH HOLLOW CATHODE DISCHARGE PLASMA

[75] Inventors: Ady Hershcovitch, Mt. Sinai; Krsto Prelec, Setauket, both of N.Y.

[73] Assignee: The United States of America as represented by the Department of Energy, Washington, D.C.

[21] Appl. No.: 215,770

[22] Filed: Dec. 12, 1980

[51] Int. Cl.[3] ..... H01J 27/02

[52] U.S. Cl. ..... 315/111.81; 250/423 R; 313/362.1; 315/111.21; 315/111.91

[58] Field of Search ..... 315/111.21, 111.61, 315/111.81, 111.91; 313/362.1, 363.1, 161, 162, 231.3; 250/423 R, 427; 176/1

[56] References Cited

U.S. PATENT DOCUMENTS

| | | | |
|---|---|---|---|
| 3,084,629 | 4/1963 | Yevick | 310/11 X |
| 3,258,633 | 6/1966 | Swartz | 313/230 |
| 3,319,089 | 5/1967 | Debiesse et al. | 310/301 X |
| 3,363,130 | 1/1968 | Flowers et al. | 313/230 X |
| 3,381,157 | 4/1968 | Ferreira | 313/348 |
| 3,386,883 | 6/1968 | Farnsworth | 176/1 |
| 3,406,308 | 10/1968 | Yamasaki | 313/207 X |
| 3,476,971 | 11/1969 | Ligenza et al. | 313/211 X |
| 3,515,932 | 6/1970 | King | 313/207 X |
| 3,533,910 | 10/1970 | Hirsch | 176/1 |
| 3,571,734 | 3/1971 | Consoli et al. | 328/233 |
| 3,617,789 | 11/1971 | Middleton et al. | 313/230 X |
| 3,630,770 | 12/1971 | Favreau | 313/346 X |
| 3,893,768 | 7/1975 | Stephens | 313/209 X |
| 4,035,656 | 7/1977 | Ohkawa | 250/500 |
| 4,046,666 | 9/1977 | McClanahan et al. | 313/346 DC X |
| 4,087,721 | 5/1978 | Mourier | 313/209 X |
| 4,218,633 | 8/1980 | Mirtich et al. | 313/362.1 |
| 4,298,798 | 11/1981 | Huffman | 250/423 R |

OTHER PUBLICATIONS

Goebel et al., *Lanthanum Hexaboride Hollow Cathode for Dense Plasma Production,* Rev. Sci. Instrum. 49(4) Apr. 1978, pp. 469–472.

Alessi et al. *Regular and Asymmetric Negative Ion Magnetron Sources with Grooved Cathodes,* Presented at the 2nd International Symposium of Production and Neutralization of Negative Hydrogen Ions, Upton, New York, Oct. 6–10, 1980.

Prelec., *Negative Ion Based Neutral Beam for Plasma Heating,* Presented at SPIG–78, Dubrounik, Yugoslavia, Aug. 26–Sep. 3, 1978.

Kuroda et al., *Development of Negative Ion Source at the IPP Nagoya University,* Presented at the 2nd International Symposium on Production and Neutralization of Negative Hydrogen Ions and Beams, Upton, N.Y., Oct. 6–10, 1980.

*Primary Examiner*—Eugene La Roche

[57] ABSTRACT

A negative ion source of the type where negative ions are formed by bombarding a low-work-function surface with positive ions and neutral particles from a plasma, wherein a highly ionized plasma is injected into an anode space containing the low-work-function surface. The plasma is formed by hollow cathode discharge and injected into the anode space along the magnetic field lines. Preferably, the negative ion source is of the magnetron type.

10 Claims, 4 Drawing Figures

NEGATIVE ION SOURCE WITH HOLLOW CATHODE DISCHARGE PLASMA

BACKGROUND OF THE INVENTION

The U.S. Government has rights in this invention pursuant to Contract Number DE-ACO2-76CH00016, between the U.S. Department of Energy and Associated Universities, Inc.

This invention relates to sources for the production of negative ions and more particularly to negative ion sources where negative ions are formed by bombarding a low-work-function surface with hydrogen particles (i.e., atoms, ions) having energies in the range of up to a few hundred eV. Still further, this invention relates to the production of negative ions for use in generating neutral beams to be used in controlled thermonuclear reactions.

Presently one of the most promising methods proposed for the production of controlled thermonuclear reactions involves magnetic confinement of a plasma which is then heated to a temperature sufficiently high that fusion reactions occur between the nuclei in the plasma. A promising method for providing at least part of the necessary heat is by using neutral beams of energetic particles. Since the particles are neutral, they freely pass through the confining magnetic field and penetrate into the plasma, heating it. Neutral beams of deuterium or tritium also provide an effective means of refueling a thermonuclear reactor.

Although all present neutral beam systems are based on the neutralization of positive ions, negative ions are considered an attractive alternative for neutral beams in the energy range above 50 keV/nucleon. In this range of energies negative ions offer a higher neutralization efficiency and, therefore, a higher power efficiency as well than positive ions. Further, as the energy increases the neutralization of positive ions becomes less and less efficient while for negative ions the efficiency remains essentially constant with energy.

Three methods for the production of negative ions are presently being studied: Volume production via several processes leading eventually to the disassociative attachment of electrons to vibrationally excited molecules, double electron capture by positive ions in cesium or sodium vapors, and surface formation processes. Of these three methods, surface formation seems to be the most promising.

FIG. 1 shows a schematic representation of a generalized negative ion source using surface formation. Anode 10 defines an interior space 12 having openings 14. Anode 10 is maintained at a relatively higher potential, typically ground. Within space 12 a converter means 16 having a low-work-function surface 16*a* is provided and maintained at a relatively lower potential typically on the order of −100 volts with respect to the anode.

In operation, space 12 contains a gas, typically hydrogen, which is initially ionized by means such as an RF probe (not shown). Once ionized the current flow from anode 10 to cathode 16 will provide energy to maintain the ionization of the gas.

When the low-work-function surface 16*a* is bombarded by hydrogen atoms and positive hydrogen ions, a combination of surface-particle interactions (desorption, backscattering) will cause a flux of negative ions to leave the surface. These negative ions will be attracted towards opening 14 by the combined attractions of anode 10 and extractor grid means 18, which is typically at a potential of several thousand volts positive. A magnetic field 20 is provided in space 12 to confine the relatively light electrons while the relatively heavy negative ions are only slightly affected and move to openings 14 and out of space 12. Makeup gas may be provided through the additional opening 22 for continued operation.

A major problem with such sources has been a low gas efficiency (i.e., a relatively low number of negative ions extracted for the number of gas particles leaving the source) which requires high pumping power to remove the neutral background gas.

It is also known to provide a positive ion beam for bombarding the converter in a surface formation negative ion source, but such apparatus generally proves to be unduly complex.

Kuroda has described a proposed negative ion source at the Second International Symposium on Production and Neutralization of Negative Hydrogen Ions and Beams at Brookhaven National Laboratory, Upton, N.Y., The source described provides two electric discharges which generate streams of electrons. (Though Kuroda refers to these as "plasma generators" it will be obvious to those skilled in the art that the "plasma" of Kuroda will consist essentially of electrons and neutral atoms, since the "plasma" is emitted through narrow slits in positively charged anodes.) Neutral gas particles are ionized near the "emitter" (i.e., converter) to provide a flux of positive ions on the "emitter" surface. Sources of this type still have a low ionization degree and very efficient differential pumping of the gas, that has not been ionized, will have to be achieved in order to improve the gas efficiency. Further, this source is intended for experimental study of the surface formation process and the plasmas provided are believed not sufficiently dense nor highly ionized to provide the high currents needed for beams intended for controlled thermonuclear reaction applications.

BRIEF SUMMARY OF THE INVENTION

Thus, it is an object of the present invention to provide a negative ion source capable of high current, high duty cycle operation, and suitable for operation in a neutral beam apparatus intended for controlled thermonuclear reaction applications.

It is another object of the present invention to provide a negative ion source of the surface formation type, having a high gas efficiency.

It is another object of the present invention to provide a negative ion source of the surface formation type, having high current and high duty cycle capability, where plasma formation is independent of negative ion formation.

Other objects and advantages of the present invention will become apparent to those skilled in the art from the descriptions set forth below.

The above objects are achieved and the disadvantages of the prior art overcome in the present invention by means of a negative ion source comprising an anode having an interior space for containing the plasma and openings into that space. The anode is held at a first higher potential, typically ground. Within the anode space a converter having a low-work-function surface is provided for converting positive ions and neutral atoms into negative ions. The converter is held at a second lower potential typically about −100 volts. A hollow cathode is also provided within the space for discharging a plasma into that space. The hollow cathode is held at a third potential intermediate between the anode and converter potentials. Means are also provided for generating a magnetic field within the space, the field being oriented so that electrons in the plasma are restrained within the space while negative ions, being much more massive, are unaffected and preferentially allowed to pass through the openings provided. The ion source of the present invention also comprises means such as an RF probe, electric spark gap or other means known to those skilled in the art for initiating ionization of the gas within the ion source, and extractor means for extracting the negative ions formed from the source.

It should be noted that the formation of a plasma by hollow cathode discharge is well known to those skilled in the art of plasma physics. While the basic physics is not finally understood, it need not be described for understanding of the present invention, since the operation of hollow cathode discharges is simply described. The hollow cathode is simply a tube formed of a material both conductive and resistant to high temperatures through which a stream of neutral gas flows. Spaced from that tube an anode is provided, the potential between the anode and the cathode being about 50 to 100 volts. Once the neutral gas is ionized and current begins to flow between the anode and cathode, the ionization becomes selfsustaining and the hollow cathode begins to discharge a plasma which is almost fully ionized into the space between the hollow cathode and the anode. The plasma so generated has proven to be surprisingly suitable for use in negative ion sources of the surface formation type, and in the present invention has enabled the provision of negative ion sources having current densities in excess of one ampere per square centimeter of the converter surface while maintaining a background gas pressure two or three orders of magnitude lower than any previous such negative ion source.

It should also be noted that many variations of the generalized configuration shown in FIG. 1 are known to those skilled in the art, including, among others, magnetron sources, Penning sources, and duoplasmatron sources. While the present invention is suitable for use with many of these sources, in a preferred embodiment the hollow cathode discharge of the present invention is used with a magnetron type source.

In another preferred embodiment the plasma is discharged from the hollow cathodes along and parallel to the magnetic field lines within the anode space.

It is an advantage of the present invention that it provides a negative ion source capable of producing negative ion currents in excess of one ampere per square centimeter of converter surface, while having a background gas pressure two or three orders of magnitude lower than any heretofore achievable.

It is another advantage of the present invention that the hollow cathode discharge of the plasma along the magnetic field lines provides an improved confinement of the plasma electrons within the anode space.

It is another advantage of the present invention that the hollow cathodes are capable of providing a steady state flow of dense highly ionized plasma. Other objects and advantages of the present invention become apparent to those skilled in the art from the detailed description of a preferred embodiment set forth below.

DETAILED DESCRIPTION OF A PREFERRED EMBODIMENT OF THE INVENTION

Figure 2:
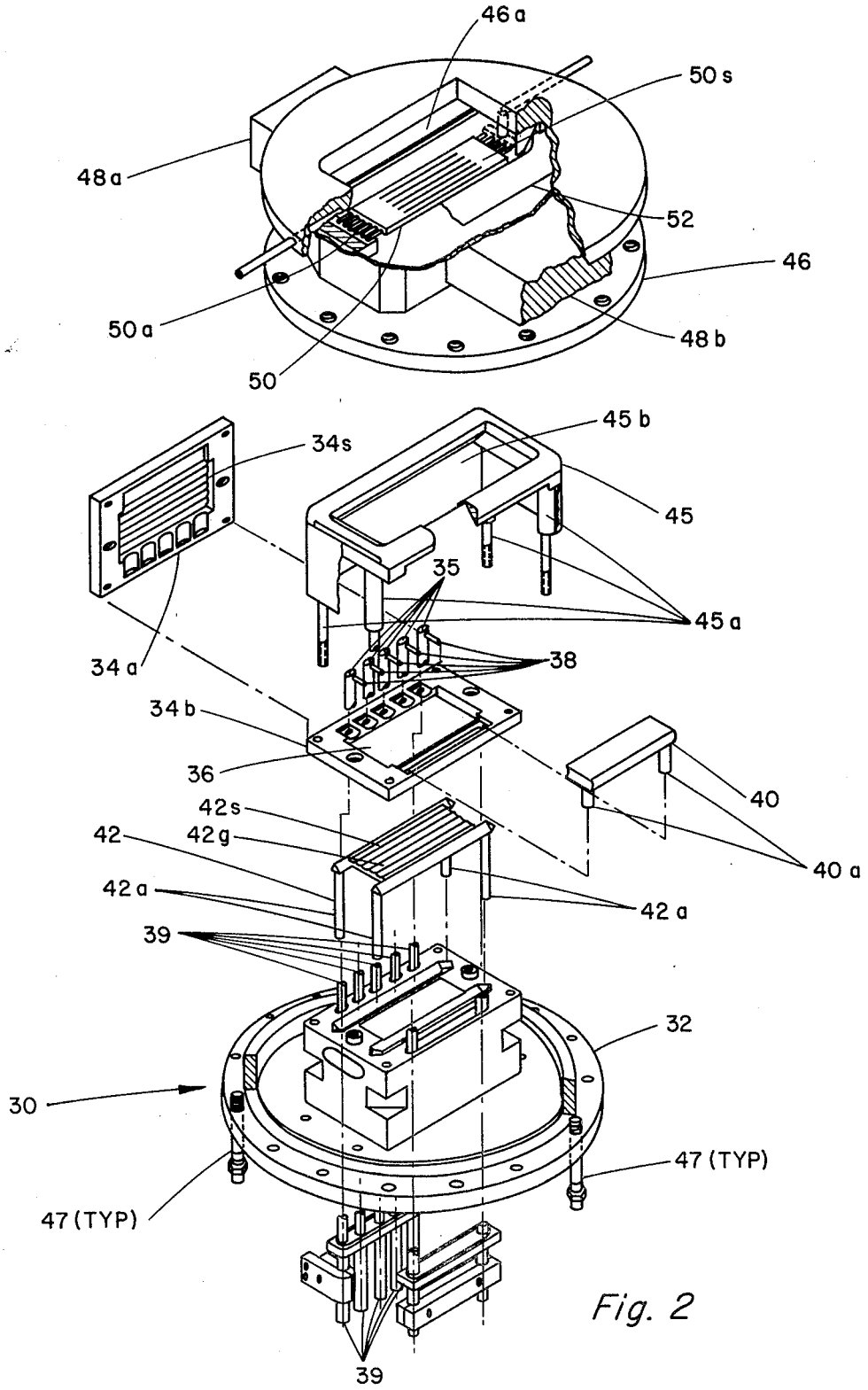
FIG. 2 shows an exploded isometric view of an embodiment of the present invention.

The FIG. 2 shows an exploded view of a negative ion source 30 in accordance with the present invention. The ion source is of the magnetron type.

Anode base 32 is assembled with and electrically connected to anode covers 34*a* and 34*b* to define an anode space 36. Within space 36 hollow cathodes 38 are mounted on gas lines 39. Spaced from and opposite to and on a level with hollow cathodes 38, a plasma dump electrode 40 is provided. Electrode 40 is cooled by a flow of fluid, preferably water, through cooling lines 40*a*. Converter 42 is also located within space 36 between hollow cathodes 38 and beam dump electrode 40 and slightly below the plane established by hollow cathodes 38 and beam dump electrode 40. Converter 42 is cooled by a flow of fluid, preferably water, through cooling lines 42*a*.

Extractor shield 45 is mounted above anode cover 34*a* so that opening 45*b* is aligned with slots 34*s* in anode cover 34*a*. Extractor shield 45 is electrically isolated from the rest of the ion source 30 and is cooled by a flow of fluid, preferably water, through cooling lines 45*a*. Cover 46 is placed over the above described elements and fastened to anode base 32 by insulating bolts 47. Magnet poles 48*a* and 48*b* are thus positioned to generate the proper magnetic field within space 36. Extractor 50 is also positioned so that extractor slots 50*s* are aligned with slots 34*s*. Extractor 50 is cooled by a fluid flow, preferably water, through cooling lines 50*a* and is protected from arcing by suppressor plate 52.

Electrical means (not shown) are provided to maintain the various components of the negative ion source 30 at the proper potentials. Anode base 32, anode covers 34*a*, 34*b* and beam dump electrode 40, are all held at ground potential. Converter 42 is held at a potential of approximately −80 volts, though this potential may be varied to optimize conversion efficiency. Hollow cathodes 38 are held at potentials approximately −50 volts. Extractor shield 45 is held at a potential of approximately +5000 volts. Extractor 50 is held at a potential of approximately +20,000 volts. Magnet poles 48*a* and 48*b* provide a field within space 36 of approximately 0.5 kilogauss.

In operation, a neutral feed gas such as hydrogen, but preferably deuterium, flows through gas lines 39 to hollow cathodes 38. Once ionization has been initiated by one of several means known to those skilled in the art, such as an RF probe or a spark gap (not shown) the ionization becomes selfsustaining and a highly ionized plasma is discharged by the hollow cathodes into space 36 along magnetic field lines. The gas flow and hollow cathode potential are adjusted so that each hollow cathode produces approximately 50 amperes of plasma discharge. The electrons in the plasma which are restrained within space 36 by the magnetic field ultimately flow to plasma dump electrode 40. Thus, the plasma dump electrode 40 both helps to prevent electrons from escaping from space 36 with the negative ions and serves to limit excessive heating of the anode.

In a preferred embodiment small amounts of cesium vapor may be added to the neutral feed gas to reduce the required potential between hollow cathodes 38 and anode 32.

Positive ions and neutral atoms within the plasma will tend to strike converter 42. Since converter 42 is formed of some material such as molybdenum coated with cesium, or lanthanum hexaboride doped with cesium, surface 42*s* will have a low-work-function and thus a relatively high portion of the particles striking surface 42*s* will be converted to negative ions (in an alternative embodiment a source of cesium vapor may be provided and converter 42 sufficiently cooled to be the coolest surface within space 36 so that the cesium on surface 42*s* will be constantly replenished).

Grooves 42*g* are parallel and aligned with slots 34*s* and extractor slots 50*s* and serve to focus negative ions coming off surface 42*s* towards these slots.

Thus, negative ions coming off of surface 42*s* are attracted by the high positive potential with extractor 50 and since they are much more massive than electrons and thus only slightly affected by the magnetic field, they tend to flow towards and through slots 34*s*, opening 45*b* in anode cover 45, and a substantial portion will flow through slots 50*s* in extractor 50 and out of the ion source through opening 46*a*.

Figure 3:
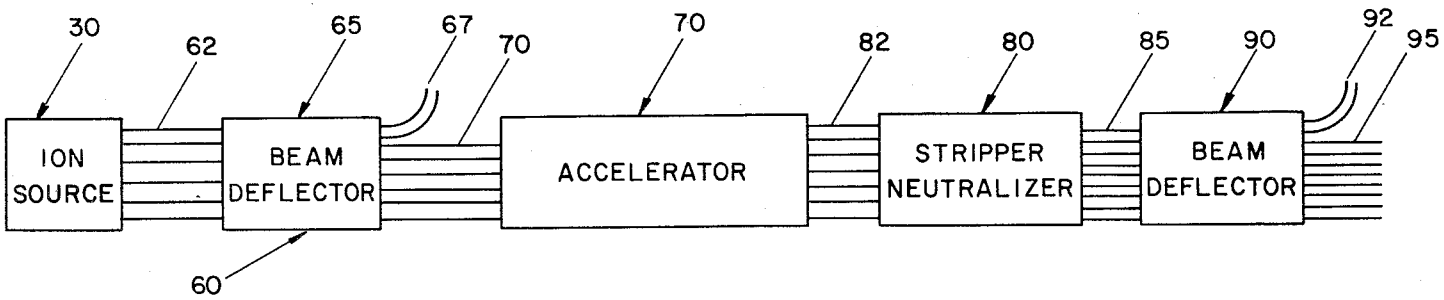
FIG. 3 shows a schematic representation of a neutral beam apparatus embodying the negative ion source of the present invention.

Turning now to FIG. 3, an ion source 30, in accordance with the present invention, is shown in a neutral beam system. The beam of negative ions 62 emitted by the source 30 includes a small residual number of electrons which have also escaped from the source. Beam 62 first passes through a beam deflector 65, preferably magnetic, where the lighter electrons are deflected from the beam path. The principles of such deflection apparatus are well known to those skilled in the art of neutral beam systems, and need not be discussed further here for understanding of the present invention. The negative ion beam 70 now freed of the deflected electrons 67 passes to an accelerator 70, preferably a linear accelerator, for acceleration to desired energies. The principles of such accelerating devices are also well known to those skilled in the art and need not be discussed further here for understanding of the present invention. A possible, highly desirable neutral beam system might use a multiple beam linear accelerator with electrostatic focusing, as described in the co-pending, commonly assigned U.S. patent application Ser. No. 152,461 to A. W. Maschke. The accelerated beam of negative ions 82 passes from the accelerator 70 to a stripper neutralizer 80. Such apparatus might comprise passing the accelerated negative ion beam 82 through jets of cesium or sodium vapor, or subjecting it to laser beams or other techniques known to those skilled in the art of neutral beam systems. As described above it is because of the high efficiency with which negative ions may be neutralized that negative ion sources gain an advantage, particularly at higher energies, over positive ion sources for use in neutral beam systems. However, the negative ion beam will not be fully neutralized but will contain some residue of negative ion as well as a possible residue of positive ions caused by the stripping of two charges from the negative ions. Thus, the partially neutralized beam 85 will be passed through a second beam deflector 90 similar to beam deflector 65, for the removal of the residue of charged ions 92. After the removal of these residual charged particles 92, beam 95 is essentially neutral and has been accelerated to the desired energy.

Figure 4:
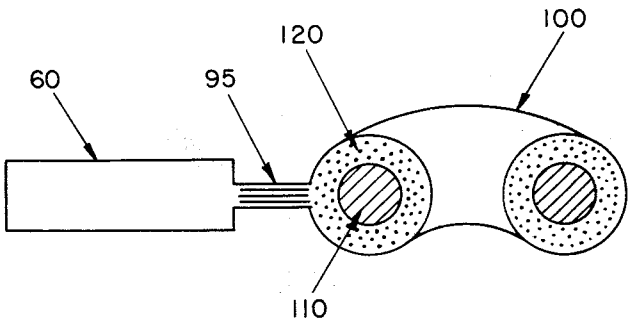
FIG. 4 is a simplified schematic representation of a controlled thermonuclear reactor of the Tokamak type embodying a neutral beam heating system.
Figure 1:
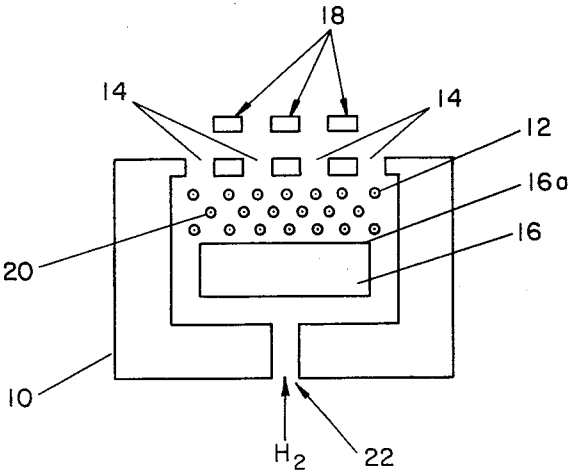
Fig. 1 PRIOR ART
FIG. 1 shows a simplified schematic representation of a generalized negative ion source of the surface formation type.

Turning now to FIG. 4, a neutral beam system, as described above, is shown in conjunction with a magnetic confinement controlled thermonuclear reactor of the Tokamak type. Tokamak type reactors are currently under development at the Princeton Plasma Physics Laboratory in New Jersey and other magnetic confinement reactors have been, or are being developed at Los Alamos Scientific Laboratory, and other laboratories in the United States. In Tokamak type reactors, a plasma 110 is confined within a toroidial vacuum vessel 100 by a magnetic field 120. The magnetic field is generated by a magnet system not shown. The energetic neutral beam 95 produced by neutral beam system 60 passes through the magnetic field 120 freely since it is not charged. As the beam penetrates the plasma 110 it gives up its energy to the plasma particles, raising their temperature to the point where fusion reactions are initiated. The energy released by these fusion reactions is recovered by other systems not shown and may be used for the generation of electrical power. A further description of the operation of magnetic confinement fusion reactors is not necessary for understanding the present invention.

The above descriptions of preferred embodiments are intended to be illustrative only. Other embodiments of the present invention, and in particular embodiment involving different configurations of negative ion sources such as Penning sources, will readily be apparent to those skilled in the art from the present application. Thus, the limitations of the present invention are to be found only in the claims set forth below.

What is claimed is:

1. A negative ion source comprising:

(a) an anode having an interior space for containing a plasma, and an opening into said space, said anode being at a first higher electrical potential;

(b) converter means within said space for converting positive ions and neutral particles into negative ions, said converter being at a second lower potential;

(c) a hollow cathode within said space for discharging a plasma into said space, said hollow cathode being at a third intermediate potential;

(d) means for initiating a discharge within said space so as to initially form said plasma;

(e) means for forming a magnetic field within said space, such field being oriented so that electrons in the plasma are restrained within said space while negative ions are preferentially allowed to pass through said opening; and (f) means for extracting negative ions formed on said converter from said space through said opening.

2. A negative ion source as described in claim 1, wherein said hollow cathodes are oriented to discharge the plasma along the magnetic field lines.

3. A negative ion source as described in claim 2, wherein said source is a magnetron source.

4. A negative ion source as described in claim 3, wherein said hollow cathode is connected to a source of hydrogen gas.

5. A negative ion source as described in claim 4, wherein the gas is deuterium or tritium.

6. A negative ion source as described in claim 5, wherein the gas further comprises cesium vapor.

7. A negative ion source as described in claim 3, further comprising a plasma dump electrode positioned opposite from said hollow cathode so as to serve as a target for the electrons in the plasma discharged by said cathode, said plasma dump electrode being at approximately the anode potential.

8. A negative ion source as described in claim 7, wherein said plasma dump electrode is cooled.

9. An apparatus for producing neutral beams of energetic particles comprising:

(a) a negative ion source including:

(1) an anode having an interior space for containing a plasma, and an opening into said space, said anode being at a first higher electrical potential;

(2) converter means within said space for converting positive ions and neutral particles into negative ions, said converter being at a second lower potential;

(3) a hollow cathode within said space for discharging a plasma into said space, said hollow cathode being at a third intermediate potential;

(4) means for initiating a discharge within said space so as to initially form said plasma;

(5) means for forming a magnetic field within said space, such field being oriented so that electrons in the plasma are restrained within said space while negative ions are preferentially allowed to pass through said openings; and (6) means for extracting negative ions formed on said converter from said space through said opening;

(b) means for focusing and accelerating the negative ions after they are extracted from said negative ion source so as to form an energetic beam; and (c) means for stripping electrons from the negative ions so as to neutralize them and form an energetic neutral beam.

10. An apparatus for producing controlled thermonuclear reactions comprising:

(a) means for confining a plasma within a magnetic field; and (b) means for heating the plasma to a temperature sufficient to cause fusion reactions between nucleons in the plasma, said means including means for producing neutral beams of energetic particles, said means including:

(1) a negative ion source including:

(A) an anode having an interior space for containing a plasma, and an opening into said space, said anode being at a first higher electrical potential;

(B) converter means within said space for converting positive ions and neutral particles into negative ions, said converter being at a second lower potential;

(C) a hollow cathode within said space for discharging a plasma into said space, said hollow cathode being at a third intermediate potential;

(D) means for initiating a discharge within said space so as to initially form said plasma;

(E) means for forming a magnetic field within said space, such field being oriented so that electrons in the plasma are restrained within said space while negative ions are preferentially allowed to pass through said openings; and (F) means for extracting negative ions formed on said converter from said space through said opening;

(2) means for focusing and accelerating the negative ions after they are extracted from said negative ion source so as to form an energetic beam; and (3) means for stripping electrons from the negative ions so as to neutralize them and form an energetic neutral beam.

* * * * *